US010163430B2

(12) United States Patent
Jashyn

(10) Patent No.: US 10,163,430 B2
(45) Date of Patent: Dec. 25, 2018

(54) TELESCOPICALLY EXTENDABLE COLLAPSIBLE PEDALBOARD

(71) Applicant: Danny Ray Jashyn, Morris (CA)

(72) Inventor: Danny Ray Jashyn, Morris (CA)

( * ) Notice: Subject to any disclaimer, the term of this patent is extended or adjusted under 35 U.S.C. 154(b) by 0 days.

(21) Appl. No.: 15/950,521

(22) Filed: Apr. 11, 2018

(65) Prior Publication Data

US 2018/0301131 A1 Oct. 18, 2018

Related U.S. Application Data

(60) Provisional application No. 62/485,143, filed on Apr. 13, 2017.

(51) Int. Cl.
*G10H 1/32* (2006.01)
*G10H 1/34* (2006.01)

(52) U.S. Cl.
CPC ..... *G10H 1/348* (2013.01)

(58) Field of Classification Search
CPC .... G10H 1/348; G10H 1/0058; G10H 1/0066; G10H 1/0083; G10H 2230/035; G10H 2240/211
USPC ..... 84/644, 721
See application file for complete search history.

(56) References Cited

U.S. PATENT DOCUMENTS 6,215,055 B1 * 4/2001 Saravis ..... G10H 1/348 84/422.1
6,459,023 B1 * 10/2002 Chandler ..... G10H 1/32 84/177
D769,364 S * 10/2016 Trifilio ..... D17/20
9,691,369 B2 * 6/2017 Trifilio ..... G10H 1/348
D815,682 S * 4/2018 Trifilio ..... D17/20
9,997,149 B2 * 6/2018 Trifilio ..... G10D 1/085
10,008,192 B2 * 6/2018 Kreifeldt ..... G10H 1/348
2007/0295190 A1 * 12/2007 Collins ..... G10H 1/32 84/422.1
2011/0271821 A1 * 11/2011 McKinney ..... G10H 1/348 84/746
2011/0303077 A1 * 12/2011 Vinciguerra ..... G10H 1/0091 84/746
2014/0131543 A1 * 5/2014 Goto ..... F16M 11/043 248/429
2015/0325224 A1 * 11/2015 Manosa Ripoll ..... G10H 1/32 84/444

(Continued)

*Primary Examiner* — Jeffrey Donels
(74) *Attorney, Agent, or Firm* — Kyle R Satterthwaite; Ryan W Dupuis; Ade & Company Inc

(57) ABSTRACT

An expandable collapsible pedalboard for supporting effects pedals or other audio processing units features a first section having a first platform, and a second section having a second platform of lesser elevation and width than said first platform. The second section is telescopically mated with the first section for sliding movement in a longitudinal direction between a retracted position placing at least a majority of the second platform beneath said first platform, and an extended position reaching outwardly beyond an end of said first section to reveal more of the second platform from beneath said first platform. Multiple pedalboards can be laid out side-by-side and fastened together to collectively form a larger modular pedalboard. A hollow space delimited between side walls of the second section can accommodate one or more power supply components for the effects pedals or other audio processing units.

11 Claims, 6 Drawing Sheets

(56) References Cited

U.S. PATENT DOCUMENTS

| | | | | |
|---|---|---|---|---|
| 2017/0098438 | A1* | 4/2017 | Trifilio | G10H 1/348 |
| 2017/0243572 | A1* | 8/2017 | Trifilio | G10D 1/085 |

* cited by examiner

TELESCOPICALLY EXTENDABLE COLLAPSIBLE PEDALBOARD

CROSS-REFERENCE TO RELATED APPLICATIONS

This application claims benefit under 35 U.S.C. 119(e) of U.S. Provisional Application No. 62/485,143, filed Apr. 13, 2017, the entirety of which is incorporated herein by reference.

FIELD OF THE INVENTION

The present invention relates generally to pedalboards for supporting effects pedals or other foot-controllable audio processing units, and more particularly to expandable collapsible pedalboards for accommodating growth or reduction of a musician's equipment collection or preferred gig-setup over time.

BACKGROUND

An effects pedal is an electronic device which adds a sonic effect to the audio signal of an electronic instrument. The pedal is turned on or off using a footswitch and is very useful for on-the-fly activation. Due to the foot-based operation of such pedals, they are also sometimes referred to as stomp boxes. Some typical electronic instruments that are compatible with effects pedals include electric guitar/bass, keyboard/synthesizer, lapsteel, resonator and organ.

Typically, the instrument would be plugged into the pedals in series using ¼" audio cables, then from the pedals into an amplifier, PA system or soundcard, though the placement of an effects pedal in the overall audio path can vary from this particular example. Pedals can vary in size, though the size of a typical pedal might average around 110 mm long×55 mm wide×40 mm high. Some of the standard effects these pedals produce would be chorus, flange, delay, overdrive, distortion, tremolo and vibrato.

In the instance of a musician with a collection of multiple pedals, particularly in the case of a recording or gigging musician who has a need to transport the pedals between venues, studios, home, practice space, etc., it is commonplace to mount the pedals to a pedalboard that can be carried from place to place and simply seated on the ground, floor, stage etc. for foot based operation of the pedals, or placed atop a table for hand-based control over the pedals. The pedals the musician likes and uses enough to warrant inclusion in their standard equipment setup are kept and fastened to the pedalboard. Others that are used less often or are not to the musician's liking may be stored separately of the pedalboard, or sold or traded.

For many musicians, the pedalboard content is an ever-changing and evolving component of their equipment setup. In many cases, it is never 100% complete. There can almost always be something to change within the content of the pedalboard, whether it's the addition or removal of a pedal, or just re-organization of where the pedals are placed relative to one another in the pedalboard layout. Accordingly, the quantity, type or layout of pedals in a pedalboard setup my vary over time, and so there is a need for pedalboard designs that can expand to accommodate a growing pedal collection, or collapse for improved portability in the event the pedal count is reduced. This way, the device can adapt to the musician's ever changing needs.

Prior solutions in this field have included modular pedalboard systems where individual units of a fixed size can be interconnected to collectively form a larger overall pedalboard assembly. One such example is a modular product marketed under the name Stompblox. One shortcoming of prior modular designs is the limited step-wise manner in which the overall pedalboard structure is adjustable in size, as the incremental increase or decrease in size is fixed according to the static size of each individual module.

A more recent product marketed as the HoleyBoard Dragonfly provides more flexibility, than prior module solutions, by providing two foot supported panels having multiple sets of fastening holes. The user can choose from among predetermined amounts of overlap between the panels to determine the overall pedalboard area collectively provided by the two panels. Using overlapping panels as the individual modules gives the user more flexibility in terms of size selectability. However, the selectable sizes are still limited according to the factory determined positioning of the selectable fastening sites on the two panels, thereby dictating the different degrees of panel overlap selectable by the user.

Accordingly, there remains room for alternatives and improvements in the field of expandable collapsible pedalboards.

SUMMARY OF THE INVENTION

According to a first aspect of the invention, there is provided an expandable collapsible pedalboard for supporting effects pedals or other audio processing units, said pedalboard comprising:

a first section having a first platform; and a second section having a second platform of lesser elevation than said first platform, said second section being telescopically mated with the first section for sliding movement in a longitudinal direction between a retracted position placing at least a majority of the second platform beneath said first platform, and an extended position reaching outwardly beyond an end of said first section to reveal more of the second platform from beneath said first platform.

According to a second aspect of the invention, the pedalboard is provided in combination with a second matching pedalboard, and said pedalboards are laid out side-by-side and fastened together to collectively form a larger modular pedalboard via one or more fastened connections made through a same set of slots in said pedalboards by which each pedalboard is lockable at a selected degree of extension by tightening of one or more fasteners through said slots.

According to a third aspect of the invention, there is provided a method of resizing an expandable collapsible pedalboard comprising telescopically extending or retracting a second section of the pedalboard relative to a first section of the pedalboard in order to adjust a degree of extension by which a second platform of the second section reaches out from under a first platform of the first section in a longitudinal direction in which the second platform is telescopically slidable relative to the first platform, and locking said first and second platforms together at the selected degree of extension.

According to a fourth aspect of the invention, there is provided a method of assembly two pedalboards together to form a collectively larger modular pedalboard, said method comprising fastening said two pedalboards together in side-by-side relation through a same set of longitudinal slots by which the two pedalboards are each longitudinally expandable and collapsible and lockable at a selected degree of extension.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1:
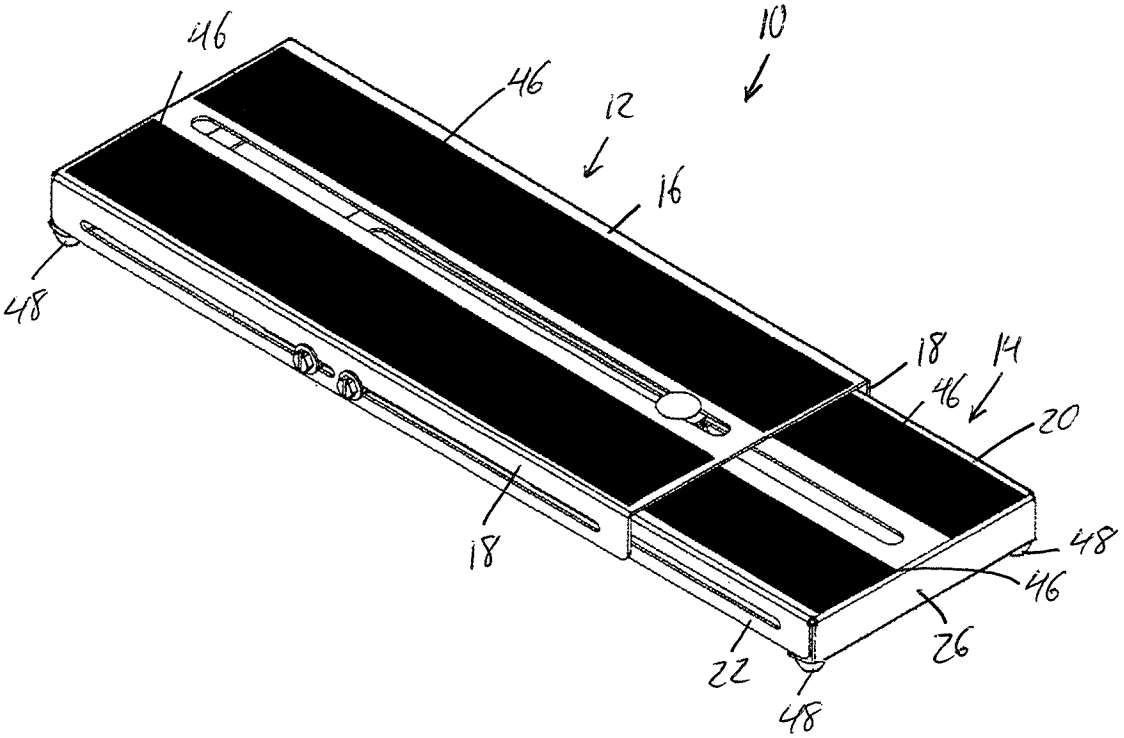
FIG. 1 is a perspective view of a telescopically expandable collapsible pedalboard according to a first embodiment of the present invention.

FIG. 1 shows a telescopically expandable collapsible pedalboard 10 according to a first embodiment of the present invention. With reference to the exploded view of FIG. 2, the pedalboard features an assembly of two constituent parts that are referred to herein as a first outer section 12 and a second inner section 14. The first outer section 12 features a first rectangular platform 16 having a first pair of rectangular side walls 18 depending downwardly therefrom in parallel relation to one another at opposing longitudinal sides of the first rectangular platform 16. Similarly, the second inner section 14 features a second rectangular platform 20 having a second pair of rectangular side walls 22 depending downwardly therefrom in parallel relation to one another at opposing longitudinal sides of the second rectangular platform 20. Each section may be formed from a singular bent sheet of metal, a central area of which defines the horizontal platform, and two opposing edge-adjacent areas of which are bent perpendicularly from the central platform area to hang vertically downward therefrom.

The longitudinal dimension of each section exceeds a lateral width dimension measured perpendicularly thereto from one side wall to the other. The platform and side walls of each section form an elongated downwardly-opening channel that spans a substantial entirety of the section's longitudinal dimension. The metal plate construction of each section in the illustrated embodiments also features one folded-over end wall 24, 26 bent downward from the platform and spanning fully between the two side walls, and then hooking inwardly back under the platform and side walls a short distance back toward the opposing end of the platform at a bottom flange 24*a*, 26*a* of the end wall 24, 26. Other than at this folded over end, each section is fully open over the entire bottom thereof, thus leaving a hollow fully-open space between the two side walls over a substantial entirety of the section's longitudinal dimension.

The width of the second inner section is slightly less than that of the first outer section so that the second inner section can reside within the hollow bottom space of the first outer section between the first pair of side walls, as shown in the assembled view of the pedalboard in FIG. 1. Each section, or at least the first outer section, is open at the second end thereof opposite the folded-over end wall, whereby the second section can slide through the open end of the first outer section to retract further into, or extend further from, the hollow bottom space of the first outer section.

In the assembled state of the pedalboard shown in FIG. 1, the second side walls 22 of the second inner section 14 reside closely adjacent the first side walls 18 of the first outer section 12, and the second inner section 14 is telescopically slidable back and forth in the longitudinal direction relative to the first outer section 12. The first outer section 12 embraces over the top and externally down the sides of the second inner section 14, which constrains the second inner section 14 against upward and lateral movement relative to the first outer section 12. As described in more detail below, cooperating slots and pins are used to couple the two sections together as an assembled unit and further constrain the allowable motion of the second section relative to the first section.

A first set of longitudinal side wall slots 28 are provided in the first side walls 18, and a matching second set of longitudinal side wall slots 30 are provided in the second side walls 22 at matching elevation to the first set of longitudinal side wall slots 28. In the illustrated embodiments, each side wall of each section features two such side wall slots situated end-to-end with one another, though a greater or lesser number of slots may be employed in each side wall. At each side of the pedalboard, at least one guide pin 32 in the form of a threaded bolt fastener has a threaded cylindrical shaft 32*a* with an enlarged head 32*b* at one end. The threaded shaft 32*a* of each guide pin 32 passes through one of the first section's side wall slots 28 and onward through an aligned one of the second inner section's side wall slots 30. As shown, the pin shaft 32*a* may pass through a pair of washers 33 respectively found at the outer face of the first side wall 18 and the inner face of the second side wall 33.

A corresponding nut 34, preferably a manually tightenable wingnut, is engaged onto the threaded shaft 32*a* of each guide pin 32 at the end thereof opposite the pin head 32*b*. The head 32*a* and nut 34 of each guide pin 32 have outer diameters exceeding the width of the side wall slots 28, 30 of the two sections, where the head and nut cooperate to maintain the guide pin in its installed position in the aligned side wall slots 28, 30.

The installed guide pins 32 further constrain the movement of the second section 14 of the pedalboard relative to the first section 12, as the engagement of each guide pin 32 through the aligned side wall slots 28, 30 of the two sections prevents the second inner section 14 from dropping out the open bottom of the first outer section 12. Accordingly, with the side walls 18, 22 of the two sections 12, 14 blocking lateral movement between the two sections, and with the guide pins 30 in the side wall slots 28, 30 preventing lifting and lowering of the second section 14 from its telescopically received position under the platform 16 of the first section 12, movement of the second section 14 relative to the first is substantially constrained to sliding displacement in the longitudinal direction. This allowed sliding movement enables retraction and extension of the second section into and from the first section via the open end thereof.

In addition to the side wall slots 28, 30, a respective longitudinal platform slot 38, 40 is provided in each platform 16, 20, for example at a central location thereacross. An additional upright guide pin 42 features a threaded shaft 42*a* passing through the two aligned platform slots, preferably via washers 43 situated above and below the two platforms 16, 20. A respective nut 44, again preferably in the form of a manually tightenable wing nut, is engaged on the threaded shaft 42*a* of the upright guide pin from the end thereof opposite head 42*b* of the pin 42. Again, this guide pin helps constrain and guide relative telescopic movement between the two sections. The upright pin 42 may feature a relatively low profile, rounded head 42*b* so that the pin head 42*b* has only minimal protrusion from the topside of the first platform to minimize interference with placement of pedals/units thereon.

The pedalboard is expandable and collapsible in length by adjusting to the degree to which the second inner section 14 is extended from the open end of the first outer section 12. The exposed portion of the second platform 20 reaching out from beneath the first platform 16 cooperates with the fully exposed first platform 16 to collectively define the total available platform space on which effects pedals or other audio processing units can be placed. Once the desired degree of extension is attained, the user tightens the nuts 34, 44 on the threaded shafts of the guide pins 32, 42. In this tightened state, each side wall guide pin 32 and its cooperating nut 34 clamps together the two adjacent side walls of the first and second sections. Likewise, the platform guide pin 42 and its cooperating nut 44 clamps together the two platforms 16, 20. The tightened state thus locks the two sections together at the selected degree of extension. Accordingly, the same nut-equipped guide pins that couple the two sections together and constrain the relative movement therebetween also serve as lock fasteners for selectively locking the pedalboard at a selected length according to the space required to accommodate a particular set of pedals or other units atop the pedalboard.

Each platform 16, 20 features hook or loop fastening material 46 adhered thereto to span a substantially full length of the platform on each side of the respective platform slot 38, 40, whereby mating hook or loop fastening material adhered to the underside of each pedal or other processing unit can be used to releasably fasten the pedal or unit to the exposed topside area of either platform 16, 20. The bottom flanges 24*a*, 26*a* of the fold-over ends 24, 26 of the illustrated embodiments each provide a mounting surface at the bottom of the respective section for installation of mounting of rubber feet 48 thereto at the corners of the section where the side walls and closed end intersect, for example by rivets 49, screws, or adhesive. Accordingly, the two feet on each section cooperate with the two feet of the other section to support the two sections in a slightly elevated position of the ground, stage, platform, amplifier, table or other support surface on which the pedalboard is placed.

Figure 3:
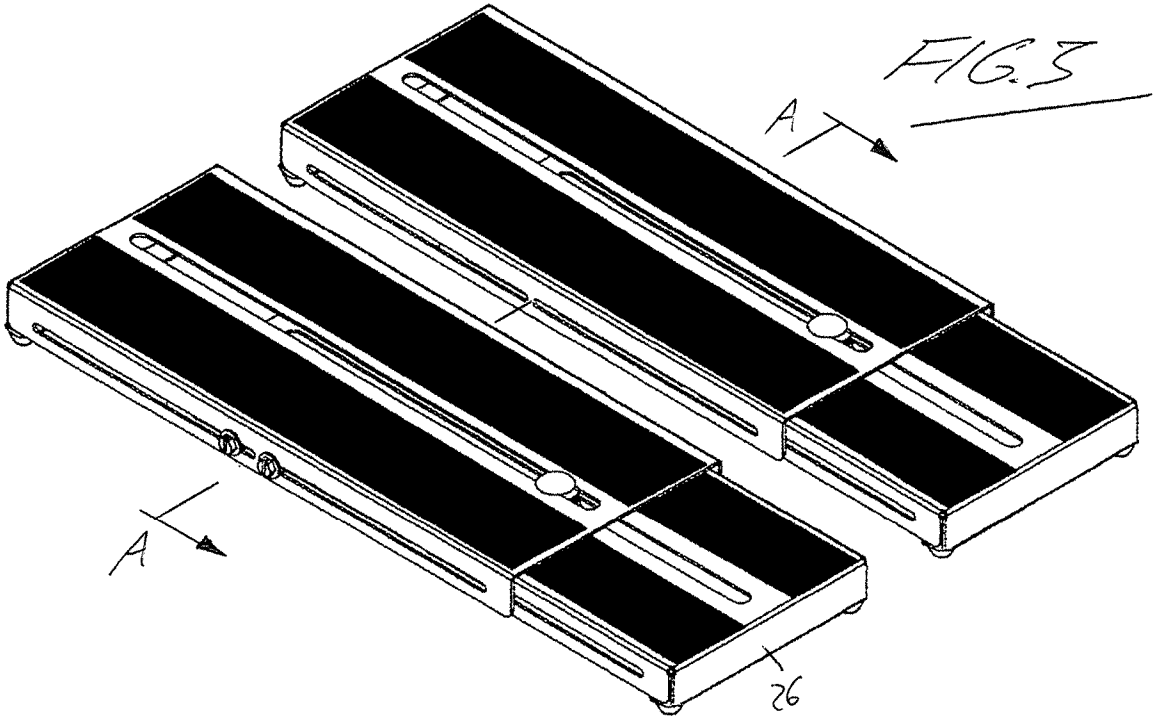
FIG. 3 is a perspective view illustrating assembly of two first embodiment pedalboards to collectively define a larger modular pedalboard.
Figure 4:
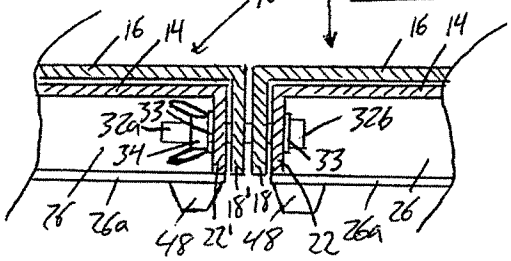
FIG. 4 is a cross-sectional view illustrating a fastened connection between the two first embodiment pedalboards once assembled to form the larger modular pedalboard, as would be viewed along line A-A of FIG. 3.

With the second section 14 having an open-bottom hollow underside like that of the first section 16, a power supply 50 or other power-related component may be mounted beneath the second platform so as not to occupy valuable space on the pedal-accommodating topside of the platforms. The undermounted component may be a rechargeable DC power supply 50 of a known type employing a rechargeable battery pack 54 having a charging port 56 by which the battery pack can be charged from a mains power outlet via an AC/DC adapter 58, and numerous output ports by which power cables 60 can be run from the battery pack to a set of pedals or other audio processing units. One such commercially available rechargeable DC power supply is the Volto™ by Pedaltrain™, a 9V power supply suitable for use with conventional pedals that are known to employ either 9V batteries or 9V AC/DC adapters for power. Hook or loop fastener material 62 adhered to the power supply 50 can releasably engage with a mating piece of hook or loop fastener material adhered to the underside of the second platform 20 to releasably fasten the power supply 50 in the hollow bottom space of the second section 14. The power cables 60 from the power supply 50 are routed upwardly through the platform slots 38, 40 to individual pedals/units mounted to the exposed platform areas at the top of the pedalboard Turning to FIGS. 3 and 4, multiple pedalboards can be assembled in side-by-side relation to one another to collectively form a larger modular pedalboard. This is accomplished by fastening the side wall guide pins 32 to their respective nuts 34 through not just a pair of adjacent first and second side walls 18, 22 of one pedalboard, but also through a corresponding pair of adjacent first and second sidewalls 18', 22' of the neighbouring pedalboard 10'. So, the width of the modular pedalboard can be increased and decreased in a stepwise manner by the fixed-width of each individual pedalboard module, while the length of the modular pedalboard can be adjusted in a more user-controllable manner by the user-selectable degree of longitudinal extension of the individual pedalboard modules.

Figure 2:
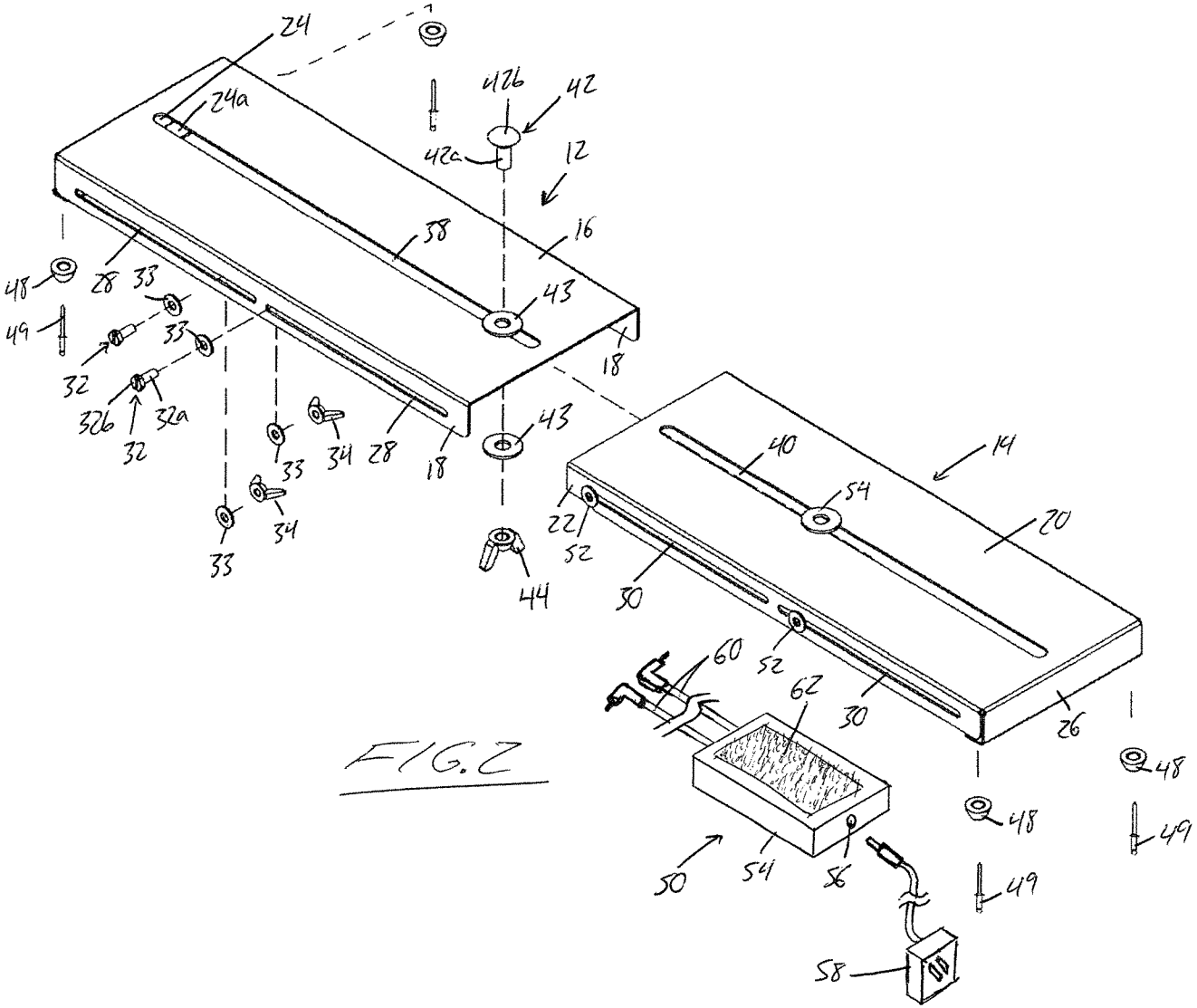
FIG. 2 is an exploded perspective view of the pedalboard of FIG. 1 with an optional power supply component.

The use of elongated slots to determine the fastenable areas at which the two sections 12, 14 of each pedalboard are lockable together provides the user with a high degree of length-adjustability, as the sections can be fastened at any selectable location along the aligned slots in the first and second sections. Together with guided telescopic expansion collapse in a singular predetermined longitudinal direction, the adjustment is easily performed via three simple steps, i.e. loosening of the guide pin lock fasteners, sliding the telescopic second section to the desired degree of extension, and re-tightening of the fasteners. Use of manually operable wingnuts allows such adjustment in a completely tool-free manner, further increasing the convenience of such adjustment. With reference to FIG. 2, low-friction spacers 52, 54, e.g. nylon washers, may be provided between the side walls and platforms of the two sections of each pedal board to prevent metal-to-metal contact and reduce the coefficient of friction between the two sections during sliding thereof, for smooth free-sliding movement therebetween. The first illustrated embodiment shows such spacers as being adhered to the outer faces of the second side wall 22 and the top face of the second platform 20. Additionally or alternatively, such spacers may be adhered to the inner faces of the first side walls 18 and the bottom face of the first platform 16.

The illustrated embodiments benefit from efficient construction by using the same threaded fasteners to couple the two sections together into a single assembled unit, guide and constrain relative motion between the two sections, and enable locking of the sections together in fixed relation at the selected degree of extension. Other embodiments may vary from this, for example by employing pins on one section that engage in slots on the other section to maintain an assembled state of the components and guide and constrain the movement therebetween, while employing separate clamps or other fastening means to selectively lock the sections at the desired degree of extension. Additionally, while the first illustrated embodiment features both lateral side wall guide pins and an upright platform pin to guide and lock the sections at different locations and in different directions, the number of guide/lock components may be varied.

Figure 5:
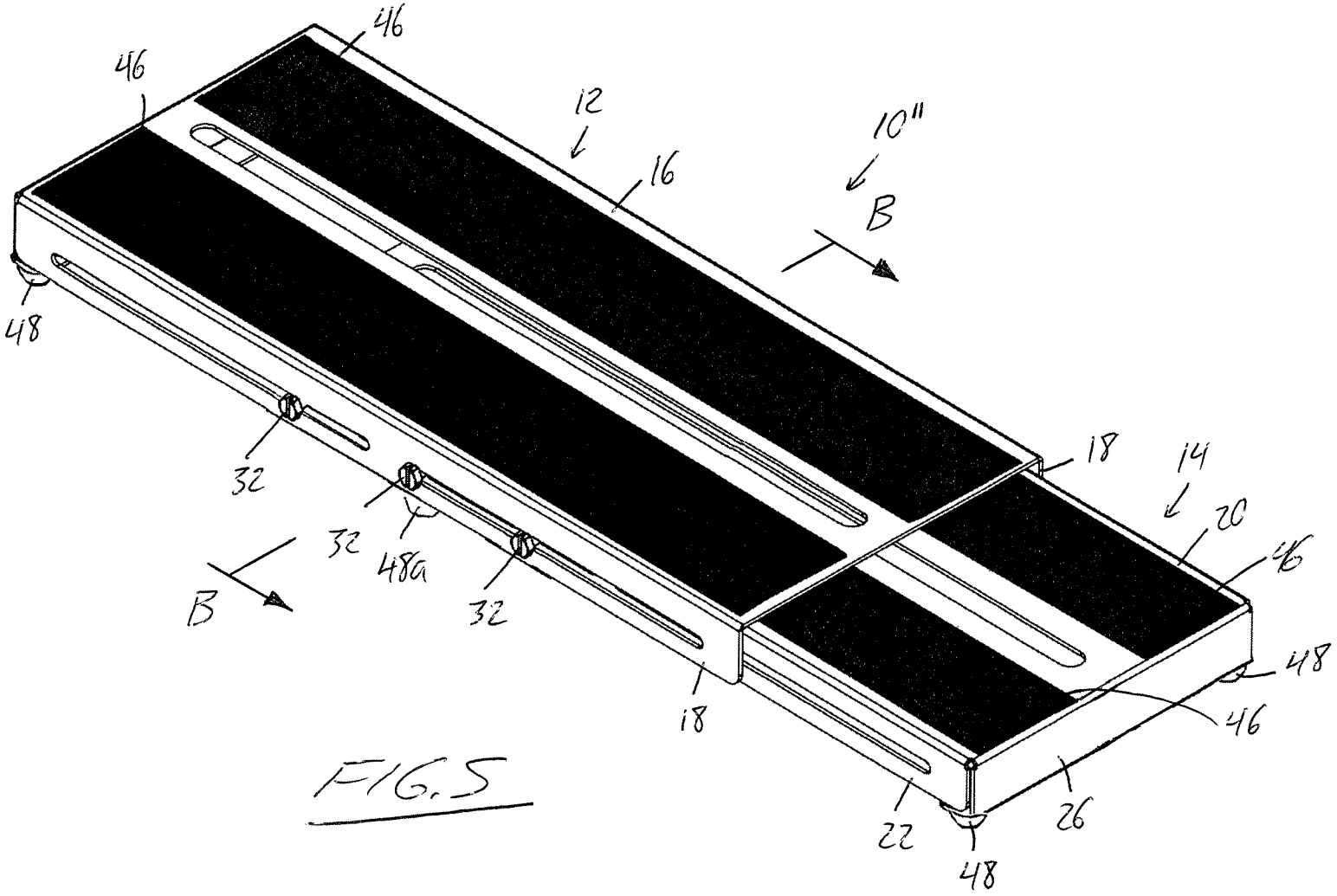
FIG. 5 is a perspective view of a telescopically expandable collapsible pedalboard according to a second embodiment of the present invention.
Figures 6, 7:
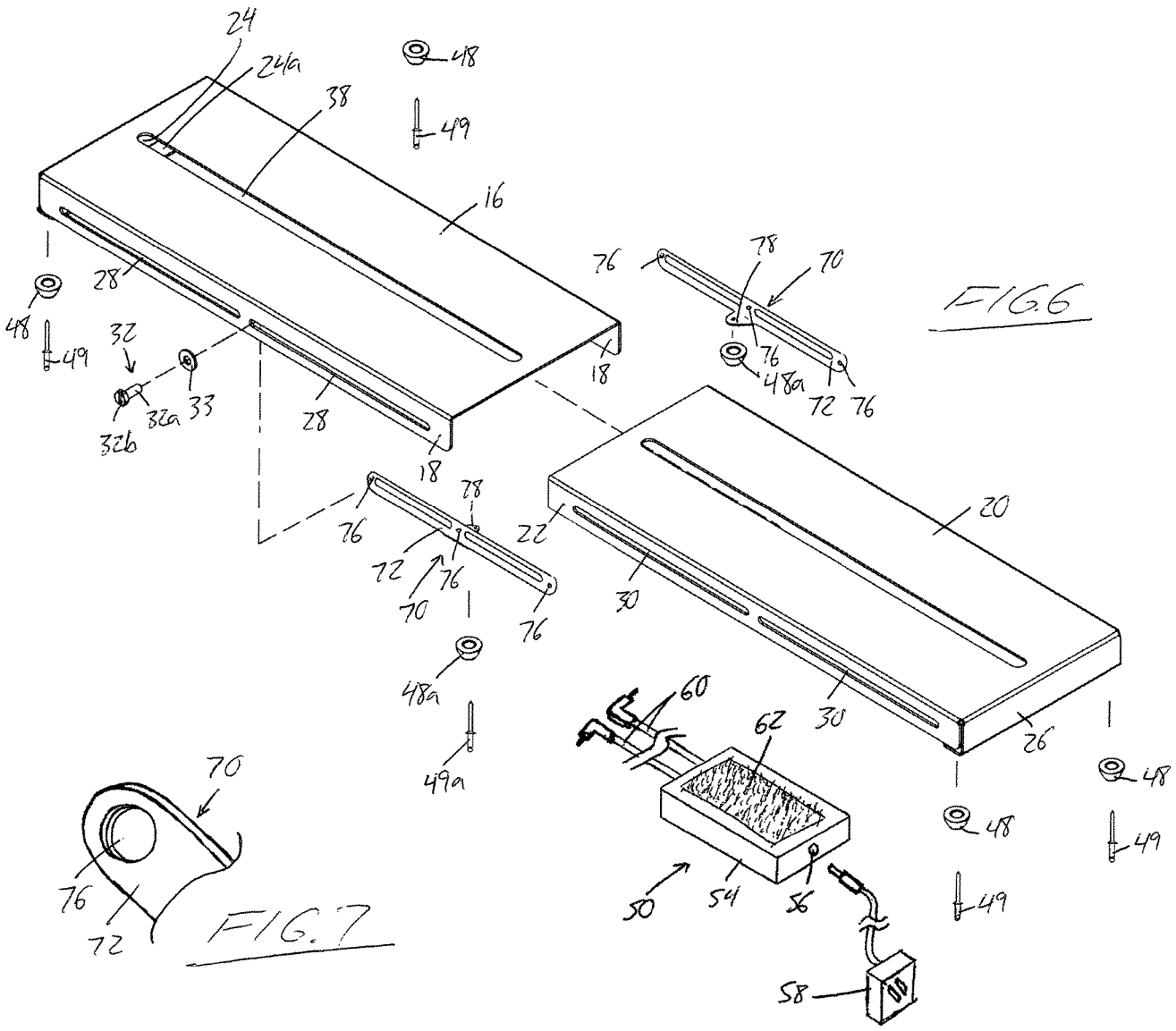
FIG. 6 is an exploded perspective view of the pedalboard of FIG. 5 with the optional power supply component.
FIG. 7 is a partial closeup view of an internal bracket from the pedalboard of FIG. 6.
Figure 8:
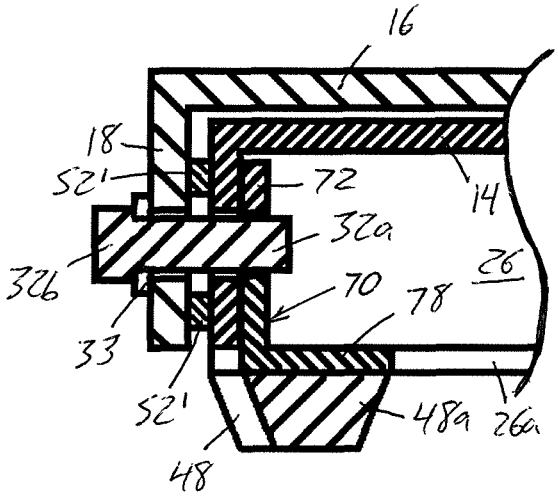
FIG. 8 is a cross-sectional view of the pedalboard of FIG. 5 as viewed along line B-B thereof.

FIGS. 5 to 9 illustrate a second embodiment pedalboard 10' that differs from the first in that in that the upright platform guide pin 42 is omitted so that the planar topside of the first platform is fully open to enable flat placement of pedals at any areas thereof, and that internal brackets 70 are used instead of wingnuts 34 for engagement by the threaded shafts 32*a* of the guide pins 32. With reference to FIG. 6, each bracket 70 features an elongated main body 72 of flat bar or plate-like shape that resides in a vertical plane parallel to a respective side wall of the inner section. The longitudinal dimension of each bracket's main body 72 lies parallel to, but is shorter than, the longitudinal dimension of the inner section. The height of each bracket's main body 72 is comparable to that of the inner section's side walls. In use, each bracket is placed flush against the inner face of a respective one of the inner section's side walls, as shown in FIG. 8.

Each bracket's main body also features a set of two or more threaded apertures 76 therein. In the illustrated example in FIG. 6, there are three such apertures, two terminal apertures residing respectively near the two ends of the main body, and a central aperture residing at the longitudinal mid-point of the bracket's main body. In the illustrated example, the weight of each bracket is reduced by the presence of a respective slot between the central aperture and the terminal aperture, but the bracket need not have a slotted structure in order to perform its intended function. In use of the bracket in its working position residing against the inner face of a respective side wall of the inner section, the bracket's threaded apertures are positioned at matching elevation to the side wall slots of the inner section so as to align therewith.

The size and thread pattern of each threaded aperture in each bracket are compatible with those of the guide pins' threaded shafts 32*a*, whereby on each side of the pedalboard, three guide pins 32 can be threaded into the respective bracket inside the inner section of the pedalboard through aligned side wall slots of the two constituent sections. Tightening of the guide pins 32 thus pulls the bracket 70 outwardly against the inner face of the inner section's respective side wall, thus clamping the two adjacent side walls of the first and second sections together in a clamped condition between the bracket 70 and the head of the guide pin in order to lock the pedalboard at the selected degree of extension.

FIG. 5 shows the pedalboard in a partially extended state with less than half of the second platform extended out from under the first platform. Here, at each side of the pedalboard, a first guide pin engages one terminal aperture of the bracket through the side wall slot of the outer section that is nearest to the closed end of the outer section, and through the side wall slot of the inner section that is nearest to the open end of the inner section. A second guide pin engages the central aperture of the bracket 70 through the side wall slot of the outer section that is nearest to the open end of the outer section, and through the same side wall slot of the inner section through which the first guide pin extends. A third guide pin engages the second terminal aperture of the bracket 70 through the same side wall slots of the inner and outer sections as the second guide pin.

As shown in FIG. 6, the spacing between the two terminal apertures of the bracket may be equal or slightly less than the length of each side wall slot in the inner and outer sections, thus enabling all three guide pins to optionally engage the respective bracket through a same side wall slot in either section. In a more extended state in which the pedalboard extended to a further degree than the partially extended state of FIG. 5, yet still not fully extended, all three guide pins may therefore be engaged with the bracket through the side wall slot of the outer section nearest the open end thereof, and through the side wall slot of the inner section nearest the open end thereof. In a more collapsed state in which the pedalboard is collapsed to a further degree than the partially extended state of FIG. 5, yet still not fully collapsed, the first and second guide pins would engage the respective apertures in the bracket through the side wall slot of the outer section nearest the closed end thereof, and through the side wall slot of the inner section nearest the open end thereof, while the third guide pin would engage the respective terminal aperture in the bracket through the side wall slot of the outer section nearest the open end thereof and through the side wall slot of the inner section nearest the closed end thereof. In a fully collapsed state of the pedal board, all three guide pins may engage the bracket either through the side wall slot of the outer section nearest the closed end thereof and the side wall slot of the inner section nearest the open end thereof, or through the side wall slot of the outer section nearest the open end thereof and the side wall slot of the inner section nearest the closed end thereof.

In a fully extended state of the pedalboard, in which the side wall slot of the inner section nearest to the open end thereof has its distal end aligned with the distal end of the side wall slot of the outer section nearest to the open end thereof, the first guide pin would be engaged in one terminal aperture of the bracket through only the side wall slot of the outer section nearest to the open end thereof, while the second guide pin would be engaged in the central aperture of the bracket through the side walls slots of the two sections nearest to the open ends thereof at the aligned distal ends of these slots, and the third guide pin would be engaged in the other terminal aperture of the bracket through only the side wall of the inner section in the same side wall slot thereof nearest to the open end of the inner section. An additional spacer washer may be included for installation over the threaded shaft of the first guide pin on each side of the pedalboard at the inner side of the outer section's side wall in this fully extended state so that tightening of the first guide pin doesn't tend to bend the engaged end of the bracket relative to the other two pin-engaged points of the bracket that abut against the inner side of the inner section's side wall.

In the first embodiment, each threaded element engaged by a respective guide pin is a single respective nut engaged individually and solely by that guide pin, whereas in the second embodiment, each threaded element engaged by a respective guide pin is a threaded aperture in a same bracket member that is engaged by other additional guide pins. In either case, the tightening of each guide pin with its matingly threaded element acts to clamp the two adjacent side walls of the inner and outer sections together between the head of the guide pin and the cooperating bracket or nut member in order to lock the pedalboard at the selected degree of extension.

In the second embodiment, each bracket also provides additional footing for the pedalboard on whatever underlying support surface it is placed on (ground, floor, stage, table, top of an amplifier, etc.). For such purpose, an in-turned flange 78 juts laterally inward from the main body 72 of each bracket 70 at the longitudinal mid-point thereof to receive attachment of additional rubber feet 48*a* to the brackets 70 at the undersides of these in-turned flanges 78, for example using additional rivets 49*a*.

Figure 9:
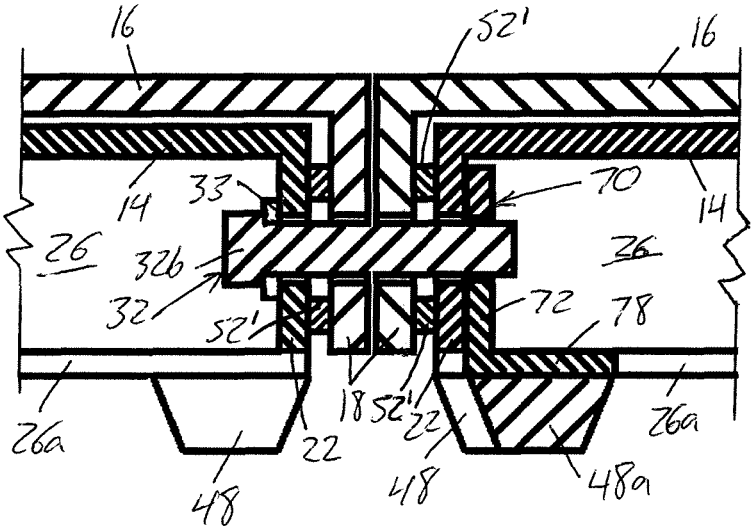
FIG. 9 is a cross-sectional view, as cut in the same plane as FIG. 8, that illustrates a fastened connection between two second embodiment pedalboards assembled to form a larger modular pedalboard like that of FIG. 3.

FIG. 9 shows how two pedalboards of the second embodiment can be fastened together in similar fashion to the first embodiment to form a larger modular pedalboard. In this case, the bracket at the side of the pedalboard on the left has been set aside or discarded, and is not used in the modular pedalboard assembly. The guide pins 32 are inserted from inside this left pedalboard, and passed through the side wall slots of both pedalboards into the installed bracket 70 of the right pedalboard. This way, where all four side walls of the two pedalboards are clamped together in sandwiched relation between the bracket 70 and the heads of the guide pins 32 in order to both couple the two pedalboards together and lock them at the selected degree of extension.

While the first embodiment used nylon washers 52 as low-friction nylon spacers between the side walls of the two sections, the cross-sectional views of FIGS. 8 and 9 illustrate alternative use of elongated spacer strips 52' of nylon or other low friction material to provide a buffer between the side walls of the two channels during sliding movement therebetween. The illustrated example uses two such spacer strips 52', one above and one below the side wall slots. The strips may be adhered to either the outer face of the inner section's side walls, or the inner face of the outer section's side walls.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An expandable collapsible pedalboard for supporting effects pedals or other audio processing units, said pedalboard comprising:

a first section having a first platform; and a second section having a second platform of lesser elevation and width than said first platform, said second section being telescopically mated with the first section for sliding movement in a longitudinal direction between a retracted position placing at least a majority of the second platform beneath said first platform, and an extended position reaching outwardly beyond an end of said first section to reveal more of the second platform from beneath said first platform;

wherein:

the first section comprises a first pair of side walls running longitudinally of and depending downwardly from said first platform on opposing sides of the second platform section to allow longitudinal extension and retraction of the second section while constraining said second section against lateral displacement in a direction transverse to said longitudinal extension and retraction;

the second section comprises a second pair of side walls running longitudinally of and depending downwardly from said second platform at locations disposed between and in close proximity to said first pair of side walls; and the second section comprises a hollow space delimited between the second pair of side walls to accommodate one or more power supply components for the effects pedals or other audio processing units.

2. The pedalboard of claim 1 in combination with a power supply component removably coupled to an underside of the second platform via hook and loop fastener.

3. The pedalboard of claim 1 comprising aligned slots in the first and second platforms via which wiring from the one or more power supply components is routable to various locations atop the first and second platforms at various degrees of extension or retraction of said second platform.

4. An expandable collapsible pedalboard for supporting effects pedals or other audio processing units, said pedalboard comprising:

a first section having a first platform; and a second section having a second platform of lesser elevation and width than said first platform, said second section being telescopically mated with the first section for sliding movement in a longitudinal direction between a retracted position placing at least a majority of the second platform beneath said first platform, and an extended position reaching outwardly beyond an end of said first section to reveal more of the second platform from beneath said first platform;

wherein:

the first section comprises a first pair of side walls running longitudinally of and depending downwardly from said first platform on opposing sides of the second platform section to allow longitudinal extension and retraction of the second section while constraining said second section against lateral displacement in a direction transverse to said longitudinal extension and retraction;

the second section comprises a second pair of side walls running longitudinally of and depending downwardly from said second platform at locations disposed between and in close proximity to said first pair of side walls; and the pedalboard further comprises side wall spacers disposed between the first and second pairs of side walls to prevent direct contact therebetween.

5. An expandable collapsible pedalboard for supporting effects pedals or other audio processing units, said pedalboard comprising:

a first section having a first platform; and a second section having a second platform of lesser elevation and width than said first platform, said second section being telescopically mated with the first section for sliding movement in a longitudinal direction between a retracted position placing at least a majority of the second platform beneath said first platform, and an extended position reaching outwardly beyond an end of said first section to reveal more of the second platform from beneath said first platform;

wherein:

the first section comprises a first pair of side walls running longitudinally of and depending downwardly from said first platform on opposing sides of the second platform section to allow longitudinal extension and retraction of the second section while constraining said second section against lateral displacement in a direction transverse to said longitudinal extension and retraction;

the second section comprises a second pair of side walls running longitudinally of and depending downwardly from said second platform at locations disposed between and in close proximity to said first pair of side walls; and the pedalboard comprises a first set of longitudinal slots in a first one of either the first pair of side walls or the second pair of side walls, and guide pins engaged to a second one of either the first pair of side walls or the second pair of side walls and received in the first set of longitudinal slots to constrain relative motion of the second section to said sliding movement in the longitudinal direction.

6. The pedalboard of claim 5 wherein the first set of longitudinal slots are provided in the first set of side walls, a second set of longitudinal slots are provided in the second set of side walls, and the guide pins are received in both said first and second sets of longitudinal slots.

7. The pedalboard of claim 5 wherein each guide pin comprises a threaded shaft mated or matable with a respective threaded opening in a cooperating member such that tightened engagement of said cooperating member on said threaded shaft locks the second platform at a selected degree of extension in the longitudinal direction.

8. The pedalboard of claim 7 wherein said cooperating member comprises an elongated bracket having a plurality of threaded openings therein at spaced positions therealong for mating of each threaded opening with a respective one of the guide pins.

9. The pedalboard of claim 4 wherein said spacers comprise reduced friction material of lesser frictional coefficient than a constituent material of the sections to reduce friction between during said sections during the sliding movement of the second section.

10. The pedalboard of claim 6 in combination with a second matching pedalboard of the same type recited in claim 6, wherein said pedalboards are laid out side-by-side and fastened together to collectively form a larger modular pedalboard via one or more fastened connections made through aligned pairs of the longitudinal slots in said pedalboards.

11. The pedalboard of claim 7 in combination with a second matching pedalboard of the same type recited in claim 7, wherein said pedalboards are laid out side-by-side and fastened together to collectively form a larger modular pedalboard via, where each guide pin and the respective cooperating member are mated together in a tightened state forming a respective fastened connection between the pedalboards though an aligned pair of the longitudinal slots of said pedalboards.

* * * * *